US011712103B2

(12) United States Patent
Altschul et al.

(10) Patent No.: US 11,712,103 B2
(45) Date of Patent: Aug. 1, 2023

(54) APPARATUS FOR CARRYING OBJECTS WITH A MOBILE COMMUNICATIONS DEVICE

(71) Applicant: Catalyst Medium Four, Inc., Austin, TX (US)

(72) Inventors: Matthew Altschul, Austin, TX (US); Beejan Soheili, Chula Vista, CA (US)

(73) Assignee: Catalyst Medium Four, Inc., Austin, TX (US)

( * ) Notice: Subject to any disclaimer, the term of this patent is extended or adjusted under 35 U.S.C. 154(b) by 0 days.

(21) Appl. No.: 16/746,794

(22) Filed: Jan. 17, 2020

(65) Prior Publication Data

US 2021/0219702 A1 Jul. 22, 2021

(51) Int. Cl.

| | |
|---|---|
| ***A45F 3/14*** | (2006.01) |
| ***A45F 3/02*** | (2006.01) |
| ***A45C 11/18*** | (2006.01) |
| ***A45C 1/08*** | (2006.01) |
| *A45C 11/00* | (2006.01) |

(52) U.S. Cl.

CPC ..... *A45F 3/02* (2013.01); *A45C 1/08* (2013.01); *A45C 11/182* (2013.01); *A45C 2001/083* (2013.01); *A45C 2001/086* (2013.01); *A45C 2011/002* (2013.01); *A45F 2200/0516* (2013.01)

(58) Field of Classification Search

CPC ..... A45F 2005/1013; A45F 3/14; A45F 2003/142; A45F 2005/006; A45F 2200/0566; A45C 1/024; A45C 5/0046; A45C 11/34; Y10T 24/1321

USPC ..... 224/250, 647, 603, 188, 223

See application file for complete search history.

(56) References Cited

U.S. PATENT DOCUMENTS

| | | | | | |
|---|---|---|---|---|---|
| 2,575,030 | A * | 11/1951 | Smallman | A45C 1/06 | 150/137 |
| 2,789,614 | A * | 4/1957 | Broughton | A45C 13/1092 | 150/130 |
| 4,449,654 | A * | 5/1984 | Cappis | A45F 3/16 | 224/684 |
| 4,722,464 | A * | 2/1988 | Wright | A45F 5/00 | 224/602 |
| 5,060,835 | A * | 10/1991 | Payne | A45F 3/16 | 224/148.2 |
| 5,657,917 | A * | 8/1997 | Johnson | A45F 3/04 | 224/582 |

(Continued)

*Primary Examiner* — Adam J Waggenspack

(74) *Attorney, Agent, or Firm* — Michael Scheinberg; Scheinberg & Associates

(57) ABSTRACT

Embodiments of the present invention are directed to an apparatus for carrying objects with a mobile communications device. In one embodiment, the apparatus includes a protective case adapted to receive a mobile communications device. The apparatus includes a carrying strap fastened to the protective case. The apparatus includes one or more loops disposed on the carrying strap. The one or more loops are adapted to receive an elongated object and hold the elongated object in a fixed position with respect to the carrying strap. In an alternative embodiment, the apparatus includes one or more pockets adapted to receive credit-card sized items. The apparatus includes a closeable flap. The apparatus includes one or more rings, each ring adapted to receive a clasp from a carrying strap. The apparatus includes an adhesive layer.

23 Claims, 9 Drawing Sheets

(56) References Cited

U.S. PATENT DOCUMENTS 6,032,841 A * 3/2000 Johnson ..... B62J 11/04 224/463
6,138,882 A * 10/2000 Buettner ..... A45C 13/00 190/102
6,375,056 B1 * 4/2002 Henri ..... A41D 27/205 224/250
6,776,318 B2 * 8/2004 Washington ..... A45F 5/021 224/676
7,204,398 B1 4/2007 Smith
7,334,714 B2 2/2008 Brown
8,504,127 B2 8/2013 Altschul et al.
8,726,952 B2 5/2014 Jambunathan et al.
8,923,938 B2 12/2014 Coughlan et al.
D721,689 S 1/2015 Altschul et al.
8,978,886 B2 3/2015 Ziemba
9,004,330 B2 4/2015 White
9,277,804 B1 * 3/2016 Gennodie ..... A45C 1/02
9,306,612 B2 4/2016 Forsythe
9,498,034 B2 11/2016 Whitten et al.
D824,892 S 8/2018 Altschul et al.
D831,630 S 10/2018 Altschul et al.
D836,096 S 12/2018 Altschul et al.
D855,607 S 8/2019 Altschul et al.
10,383,416 B2 * 8/2019 Hynecek ..... A45C 13/005
D865,742 S 11/2019 Altschul et al.
D865,743 S 11/2019 Altschul et al.
10,506,857 B2 * 12/2019 Altschul ..... A45C 13/002
2006/0176660 A1 8/2006 Amiri
2007/0057004 A1 3/2007 Butler et al.
2007/0235493 A1 10/2007 Fortson
2011/0031160 A1 2/2011 Leggett
2012/0248160 A1 10/2012 Seimetz
2012/0264491 A1 10/2012 Singhal
2014/0251534 A1 9/2014 Jambunathan
2015/0230570 A1 * 8/2015 Kim ..... H04M 1/185 150/139
2015/0334212 A1 * 11/2015 Sandu ..... H04M 1/0279 455/575.1
2017/0231373 A1 8/2017 Koren
2018/0020791 A1 * 1/2018 Cole ..... A45F 3/005 224/576

* cited by examiner

APPARATUS FOR CARRYING OBJECTS WITH A MOBILE COMMUNICATIONS DEVICE

TECHNICAL FIELD OF THE INVENTION

Embodiments of the present invention relate generally to the field of accessories for mobile communications devices and other portable electronic devices.

BACKGROUND OF THE INVENTION

Mobile communications devices are in widespread use world-wide and have become an integral part of everyday life for many people. Mobile communications devices are portable and typically handheld. Mobile communications devices are also comprised of materials and electronics that are easily broken if the device is dropped. Some people use protective cases to protect their mobile communications device.

Some protective cases for mobile communications devices include a pocket/wallet feature that allows users to carry money, credit cards, and other credit card-sized items such as driver licenses, rewards cards, membership cards, insurance cards, hotel keys, and the like. Examples of such cases with pocket/wallet features are disclosed in U.S. Pat. Nos. 8,504,127; 10,506,857; D721689; D831630; D824892; D855607; D836096; D865742; and D865743, each of which is assigned to the applicant of the present application and each of which is incorporated by reference in the present application.

Protective cases that include a pocket/wallet feature can obviate the need for the user to carry a wallet because money, credit cards, and other credit card-sized items can be carried in the protective case along with the mobile communications device. However, protective cases that include a pocket/wallet feature can only carry flat objects such as paper money and credit card-sized items. Objects that have a larger cross-sectional dimensions than flat objects do not fit inside the pocket/wallet feature. Such objects can include substantially cylindrical objects such as writing instruments, cosmetics like lipstick and lip balm, electronic cigarettes, "vape" pens, and the like. These larger cross-sectional objects are often carried when a person leaves home with a mobile communications device, credit-cards, money, and the like, however protective cases with a pocket/wallet feature cannot accommodate the larger cross-sectional objects, so the larger cross-sectional objects must be carried separately. Also, when people leave home they may wear clothing that does not have any pockets (e.g., going to the gym, going to a night club, etc.). Wearing clothing without pockets further exacerbates the problem of having to carry multiple items separately.

SUMMARY OF THE INVENTION

Embodiments of the present invention are directed to an apparatus for carrying objects with a mobile communications device. In one embodiment, the apparatus includes a protective case adapted to receive a mobile communications device. The apparatus includes a carrying strap fastened to the protective case. The apparatus includes one or more loops disposed on the carrying strap. The one or more loops are adapted to receive an elongated object and hold the elongated object in a fixed position with respect to the carrying strap.

In an alternative embodiment, the apparatus includes one or more pockets adapted to receive credit-card sized items. The apparatus includes a closeable flap. The apparatus includes one or more rings, each ring adapted to receive a clasp from a carrying strap. The apparatus includes an adhesive layer.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

DETAILED DESCRIPTION OF EMBODIMENTS

Figure 1:
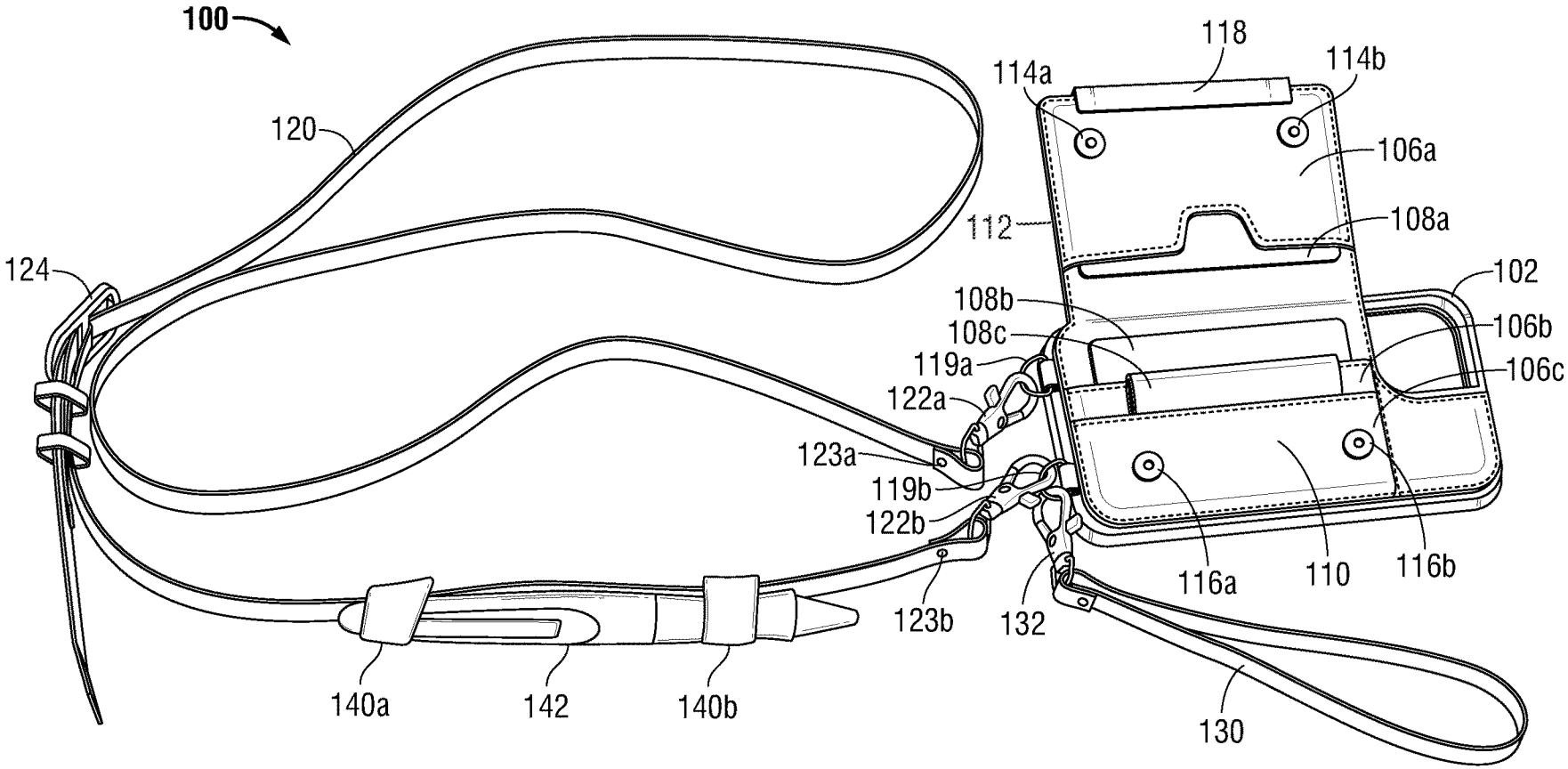
FIG. 1 shows exemplary apparatus 100 for carrying objects with a mobile communications device in accordance with embodiments of the present invention.

FIG. 1 shows an exemplary apparatus for carrying objects with a mobile communications device in accordance with embodiments of the present invention. Apparatus 100 includes protective case 102 adapted to receive mobile communications device 104 (not shown). Mobile communications device 104 can be a mobile phone, cellular phone, smartphone, iPhone, Android phone, and the like. Protective case 102 preferably conforms to the shape of mobile communications device 104. Protective case 102 is preferably formed from an elastomeric material that can absorb and dissipate energy from shocks, such as dropping the assembly on a hard surface, thereby protecting mobile communications device 104 from damage as well as preventing other damage, such as scratches. Examples of suitable elastomeric material include, but are not limited to, thermoplastic polyurethane (TPU) and polycarbonate (PC).

Protective case 102 can include one or more pockets 106*a-c*. Pockets 106*a-c* can be disposed on the back surface of protective case 102 so that pockets 106*a-c* are accessible to the user when mobile communications device 104 is disposed within protective case 102. Pockets 106*a-c* can be adapted to receive credit-card sized items 108*a-c*. Credit-card sized items 108*a-c* have at least one dimension that is substantially smaller than the other dimensions such that credit-card sized items 108*a-c* are substantially flat. Credit-card sized items 108*a-c* include any items that are similar to the size and thickness of a credit card or can be folded into the size of a credit card without substantially increasing its thickness, such as paper money. Credit-card sized items 108*a-c* can include, but are not limited to, money, credit cards, driver licenses, rewards cards, membership cards, insurance cards, hotel keys, and the like.

Figure 2:
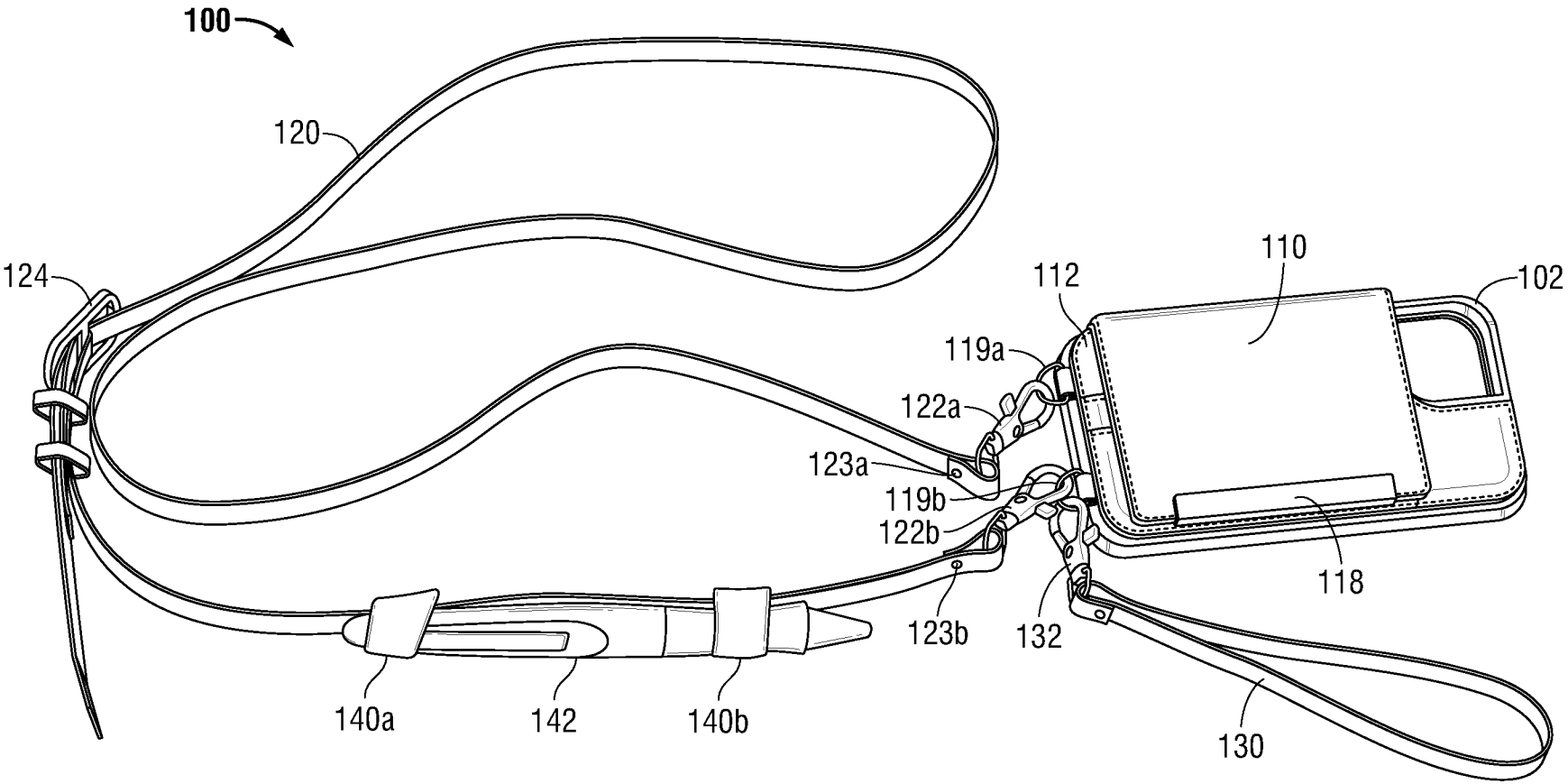
FIG. 2 shows closeable flap 112 of wallet feature 110 in the closed configuration.

Pockets 106*a-c* can be configured into a wallet feature 110 having a closeable flap 112. Closable flap 112 can be held in the closed position by one or more magnetic fasteners 114*a-b* on closeable flap 112 and one or more corresponding magnetic fasteners 116*a-b* on the portion of wallet feature 110 affixed to protective case 102. Magnetic fasteners 114 and 116 can include magnets that are attracted to each other. Alternatively, magnetic fasteners 114 and 116 can include a matched pair of a magnet and corresponding metal piece that is attracted to the magnet. For example, magnetic fastener 116*a* can be a magnet shaped to receive a metallic piece that is attracted to a magnet, and magnetic fastener 116*a* can be that metal piece. Closeable flap 112 can have a rigid protective member 118 around an outer edge to assist with opening closeable flap 112 as well as ruggedizing a portion of wallet feature 110 that is frequent touched and moved by the user. FIG. 2 shows closeable flap 112 of wallet feature 110 in the closed configuration.

Protective case 102 can include one or more rings 119*a-b*. Each of rings 119*a-b* can be adapted to receive a clasp that can be used to attach carrying strap 120 and wrist strap 130 to protective case 102.

Apparatus 100 can also include carrying strap 120. Carrying strap 120 can include first carrying strap end 123*a* and second carrying strap end 123*b*. First carrying strap end 123*a* and second carrying strap end 123*b* can be fastened to protective case 102. In at least one embodiment, first carrying strap end 123*a* can have a first clasp 122*a* adapted to be selectively fastened to and unfastened from one of rings 119*a-b*. Second carrying strap end 123*b* can have a second clasp 122*b* adapted to be selectively fastened to and unfastened from one of rings 119*a-b*. Carrying strap 120, when fastened to protective case 102, can be worn over the carrying of the user thereby enabling the user to carry the apparatus, and any objects disposed therein, without grasping the apparatus in a hand. This enables the user to carry multiple items together hands-free and without having to use pockets in clothing. In an alternative embodiment, instead of having first carrying strap end 123*a* and second carrying strap end 123*b*, carrying strap 120 can be formed into a loop. The loop can have one or more clasps 122 adapted to be selectively fastened and unfastened from one of rings 119*a-b*.

Carrying strap 120 is preferably long enough to loop from the hip to the shoulder of the user. Carrying strap 120 can, for example, be worn over the shoulder or across the body. Carrying strap 120 can be adjustable in length. Carrying strap 120 can include buckle 124 for adjusting the length of carrying strap 120. While the term "carrying" is used in connection with carrying strap 120 for identification purposes, and to distinguish carrying strap 120 from wrist strap 130, carrying strap 120 is not limited to being used to carry apparatus 100. For example, carrying strap 120 can be used to hang apparatus 100 on a peg, a hanger, a coat rack, and the like.

Figure 3:
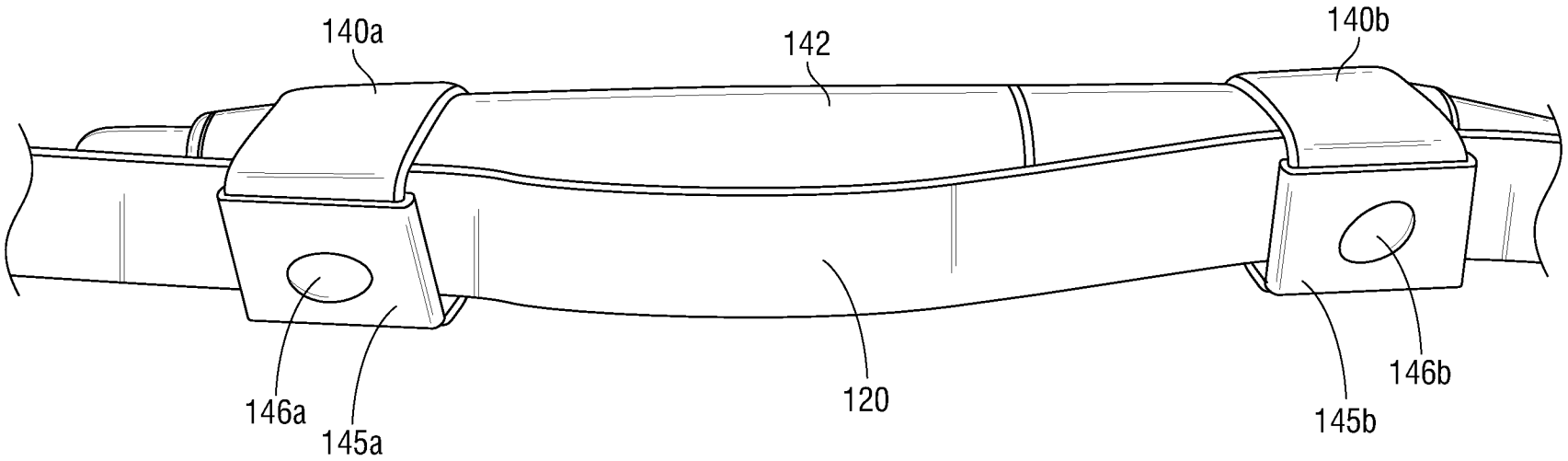
FIG. 3 shows a magnified view of carrying strap 120 in the location of loops 140*a-b;*

Carrying strap 120 can include one or more loops 140*a-b* adapted to receive an elongated object 142. FIG. 3 shows a magnified view of carrying strap 120 of exemplary apparatus 100 in the location of loops 140*a-b*. Loops 140*a-b* can wrap around carrying strap 120 providing a loop of a dimension suitable to conform to a variety of commonly used elongated objects 142. Loops 140*a-b* can be fastened to carrying strap 120 by way of loop fasteners 146*a-b*. Each of loop fasteners 146*a-b* can be a decorative rivet or brad that matches the appearance of buckle 124, clasps 122*a-b*, clasp 132 (described below), rigid protective member 118, and rings 119*a-b*. Reinforcing material 145*a-b* can be wrapped around loops 140*a-b* where loop fasteners 146*a-b* pass through loops 140*a-b* and carrying strap 120 to prevent tearing and improve reliability. Reinforcing material 145*a-b* can be made of the same material as carrying strap 120 to enhance the appearance of apparatus 100.

Figure 4:
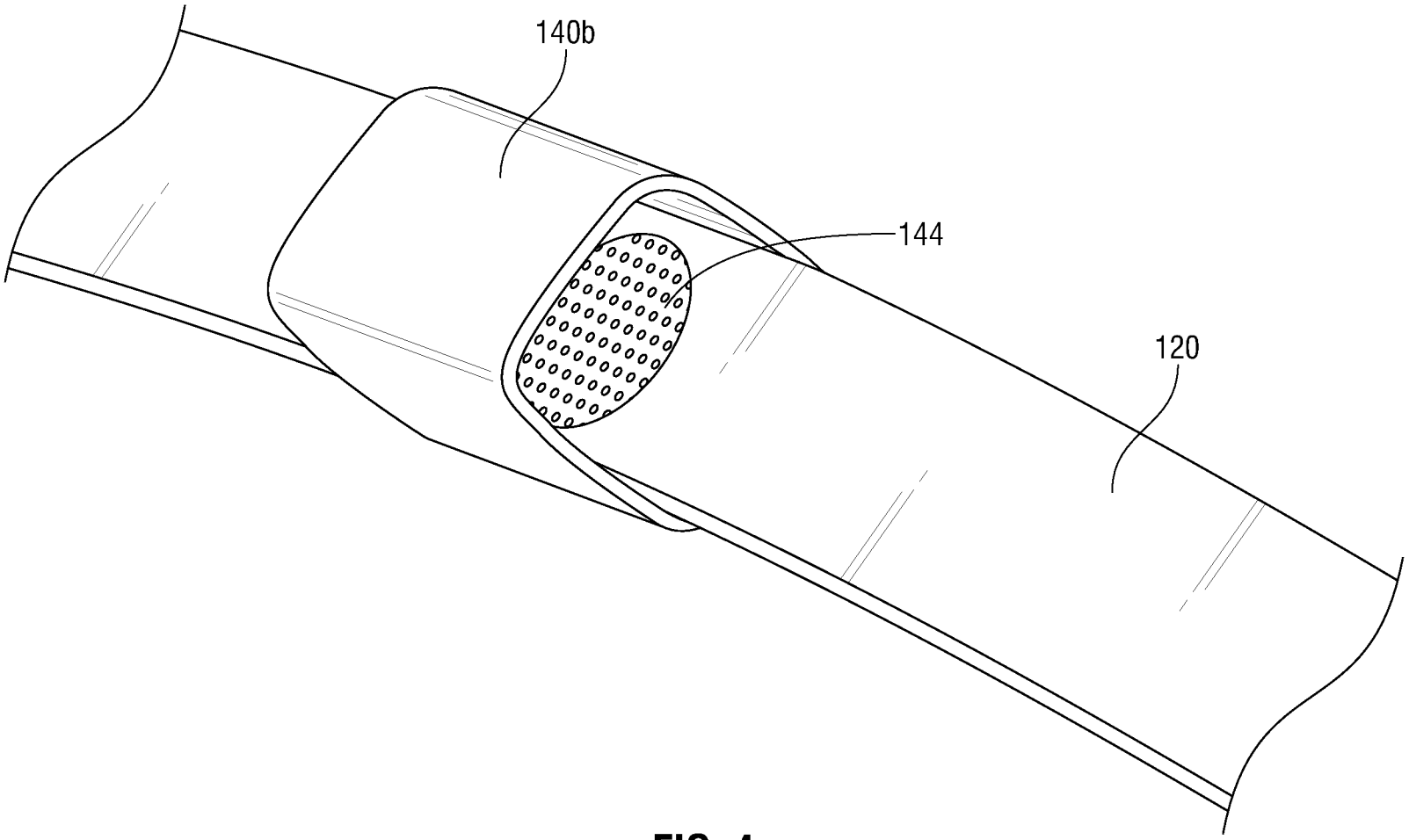
FIG. 4 shows a magnified view of carrying strap 120 with loop 140 pulled back to show grip 144.

In a preferred embodiment, loops 140*a-b* can be made from an elastic material. The elastic material can stretch to receive and conform to elongated object 142. Tension in the stretched elastic material operates by way of increased friction to hold elongated object 142 in place with respect to carrying strap 120. To further increase the frictional forces holding elongated object 142 securely in place relative to carrying strap 120, grips 144 can be affixed on carrying strap 120 in the locations where loops 140*a-c* wrap around carrying strap 120. FIG. 4 shows a magnified view of carrying strap 120 with loop 140 pulled back to show grip 144. Grips 144 can be made of a material that increases the frictional forces holding elongated object 142 securely in place relative to carrying strap 120. Grips 144 can be patterned with a texture that increases the frictional forces holding elongated object 142 securely in place relative to carrying strap 120.

Elongated object 142 has a cross-section that is not flat compared to credit card-sized items 108*a-c*. Due to the larger cross-sectional dimension than credit card-sized items 108*a-c*, elongated object 142 does not fit inside the any of pockets 106*a-c*. Elongated object 142 can include substantially cylindrical objects such as, but not limited to, writing instruments, cosmetics like lipstick and lip balm, electronic cigarettes, "vape" pens, and the like. Loops 140*a-b* enable the elongated object 142 to be secured to apparatus 100. This enables the user to carry multiple items together hands-free, including an elongated object 142, and without having to use pockets in clothing.

Apparatus 100 can also include wrist strap 130. Wrist strap 130 can be fastened to protective case 102 with clasp 132. Wrist 120 strap can have its ends connected together to form a loop adapted to be worn around the wrist of the user, thereby enabling the user to carry apparatus 100, and any objects disposed therein, without grasping apparatus 100 in a hand. While the term "wrist" is used in connection with wrist strap 130 for identification purposes, and to distinguish wrist strap 130 from carrying strap 120, wrist strap 130 is not limited to being used around the wrist. For example, wrist strap 130 can be used to hang apparatus 100 on a peg, a hanger, a belt, a coat rack, and the like.

Figure 5:
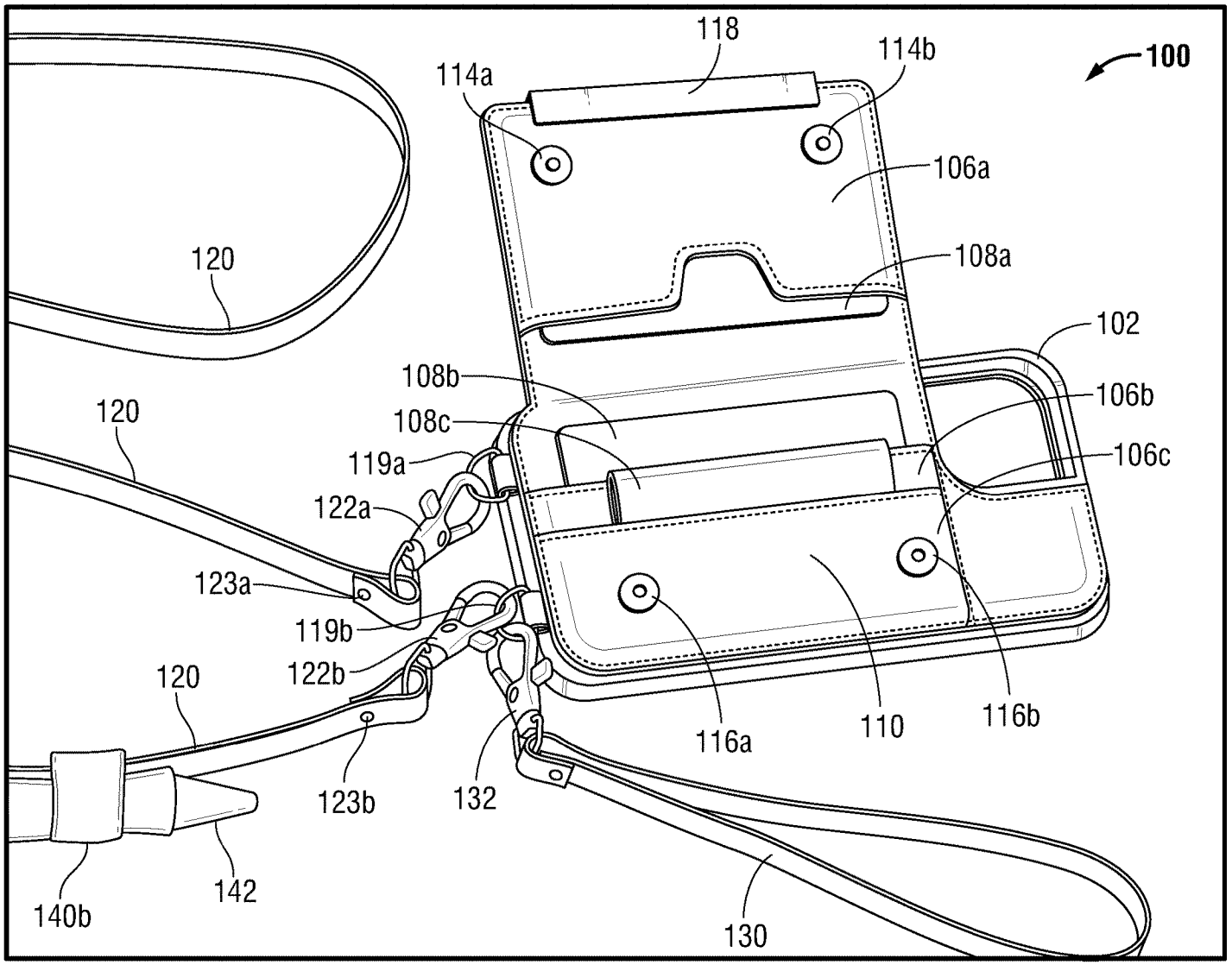
FIG. 5 shows a magnified view of protective case 102 of apparatus 100 with closeable flap 112 of wallet feature 110 in the open configuration.
Figure 6:
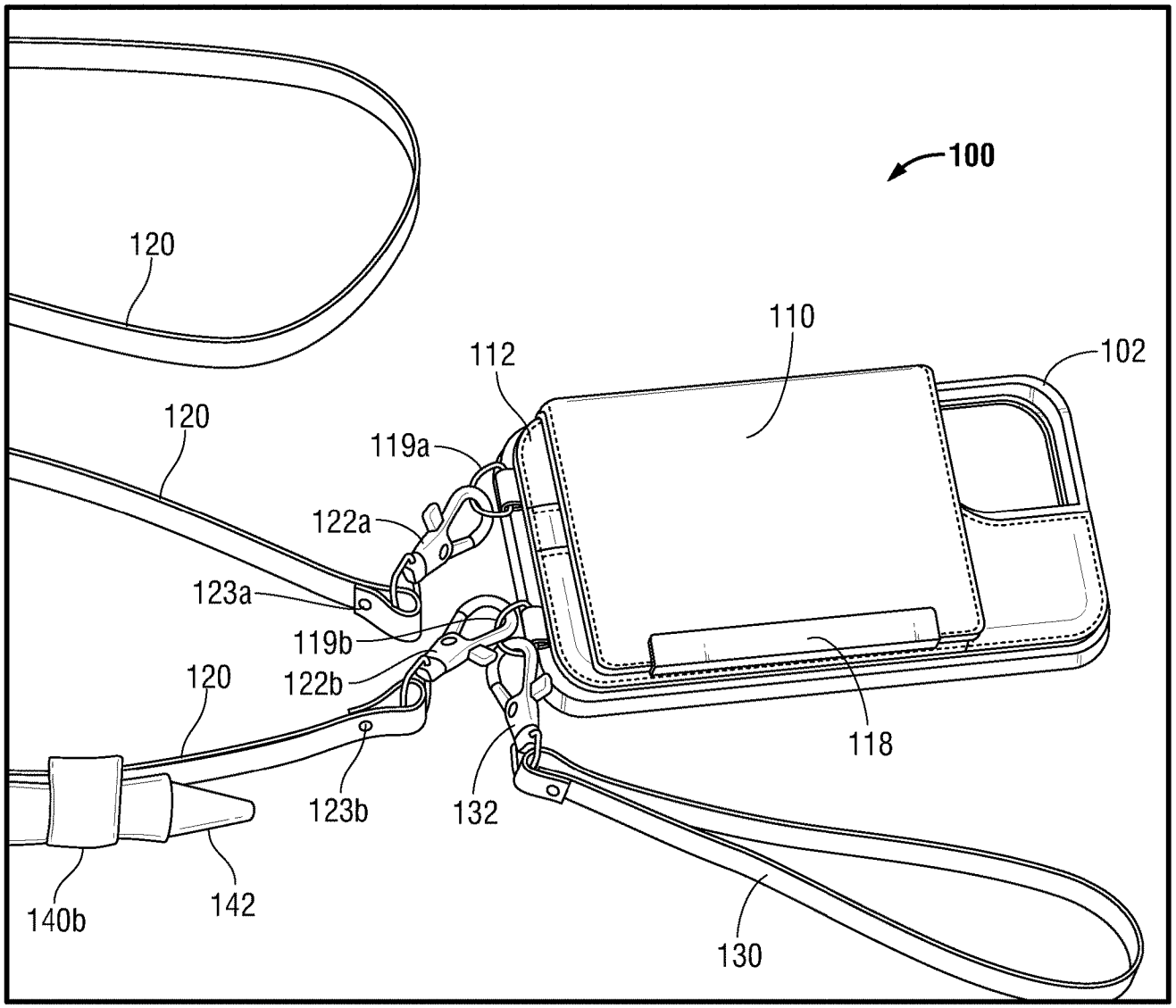
FIG. 6 shows a magnified view of protective case 102 of apparatus 100 with closeable flap 112 of wallet feature 110 in the closed configuration.

FIG. 5 shows a magnified view of protective case 102 of apparatus 100 with closeable flap 112 of wallet feature 110 in the open configuration. FIG. 6 shows a magnified view of protective case 102 of apparatus 100 with closeable flap 112 of wallet feature 110 in the closed configuration.

Figure 7:
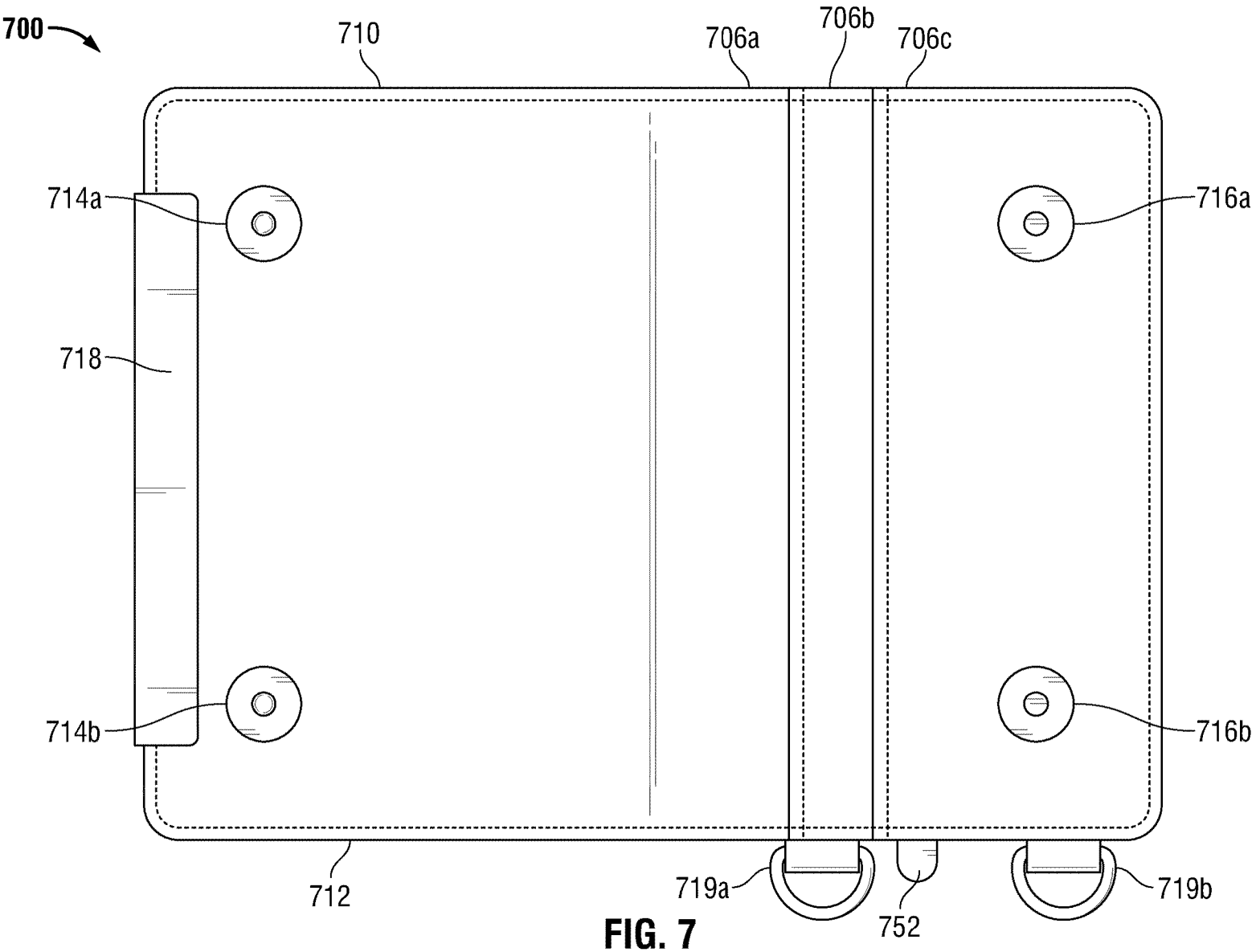
FIG. 7 shows a view of the interior of wallet feature 710 in the open configuration.

FIGS. 7-10 show an alternative embodiment wherein wallet feature 710 can be a piece that is sold separately from a protective case and applied by the user to the back of any of a number of protective cases or directly to the back of the phone without a protective case by way of an adhesive backing. FIG. 7 shows a view of the interior of wallet feature 710 in the open configuration. Wallet feature 710 can include one or more pockets 706*a-c*. Pockets 706*a-c* can be adapted to receive credit-card sized items 108*a-c*. Credit-card sized items 108*a-c* have at least one dimension that is substantially smaller than the other dimensions such that credit-card sized items 108*a-c* are substantially flat. Credit-card sized items 108*a-c* include any items that are similar to the size and thickness of a credit card or can be folded into the size of a credit card without substantially increasing its thickness, such as paper money. Credit-card sized items 108*a-c* can include, but are not limited to, money, credit cards, driver licenses, rewards cards, membership cards, insurance cards, hotel keys, and the like.

Wallet feature 710 can include closeable flap 712. Closable flap 712 can be held in the closed position by one or more magnetic fasteners 714*a-b* on closeable flap 712 and one or more corresponding magnetic fasteners 716*a-b* on the portion of wallet feature 710 that is facing closeable flap 712. Magnetic fasteners 714 and 716 can include magnets that are attracted to each other. Alternatively, magnetic fasteners 714 and 716 can include a matched pair of a magnet and corresponding metal piece that is attracted to the magnet. For example, magnetic fastener 716*a* can be a magnet shaped to receive a metallic piece that is attracted to a magnet, and magnetic fastener 716*a* can be that metal piece. Closeable flap 712 can have a rigid protective member 718 around an outer edge to assist with opening closeable flap 712 as well as ruggedizing a portion of wallet feature 710 that is frequent touched and moved by the user. Wallet feature 710 can include one or more rings 719*a-b*. Each of rings 719*a-b* can be adapted to receive a clasp that can be used to attach carrying strap 120 and wrist strap 130 to wallet feature 710.

Figure 8:
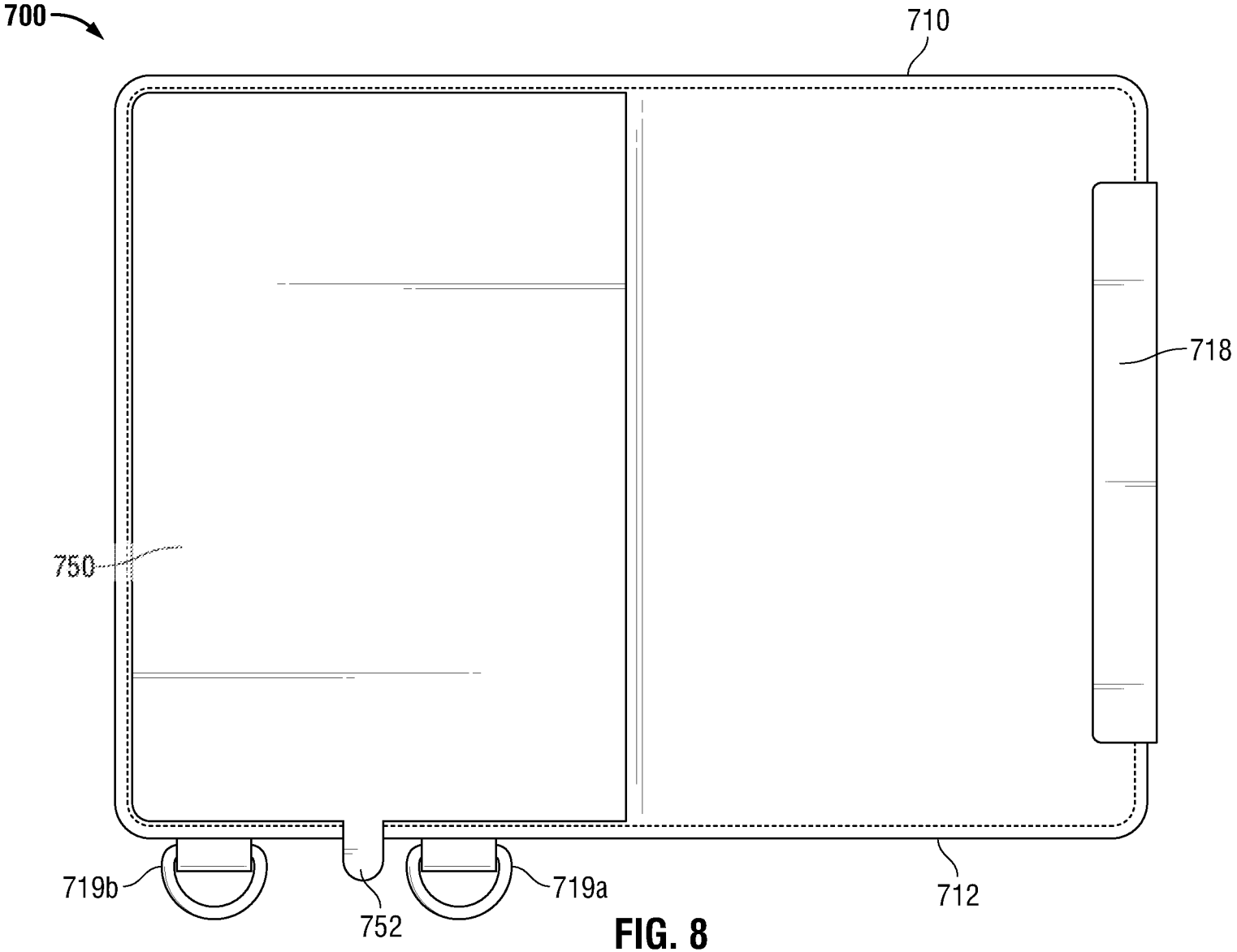
FIG. 8 shows a view of the exterior of wallet feature 710 in the open configuration.

FIG. 8 shows a view of the exterior of wallet feature 710 in the open configuration. A portion of the exterior surface of wallet feature 710 preferably includes an adhesive layer 750. Adhesive layer 750 is preferably disposed on the portion of the exterior surface of wallet feature 710 in a position that is suited for affixing wallet feature 710 to a phone device or protective case for a phone device by way of the adhesive in adhesive layer 750 without inhibiting the ability of closeable flap 712 to be selectively opened and closed. Adhesive layer can comprise, for example, but is not limited to, 300LSE adhesive by 3M. Adhesive layer 750 can include a protective backing to preserve and maintain the adhesive properties of adhesive layer 750 until such time as the user is ready to apply wallet feature 710 to a phone device or protective case for a phone device. Tab 752 can be included to facilitate the removal of the protective backing. A portion of tab 752 is disposed between adhesive layer 750 and the protective backing. The user can pull on tab 752 to separate and remove the protective backing from adhesive layer 750.

Figure 10:
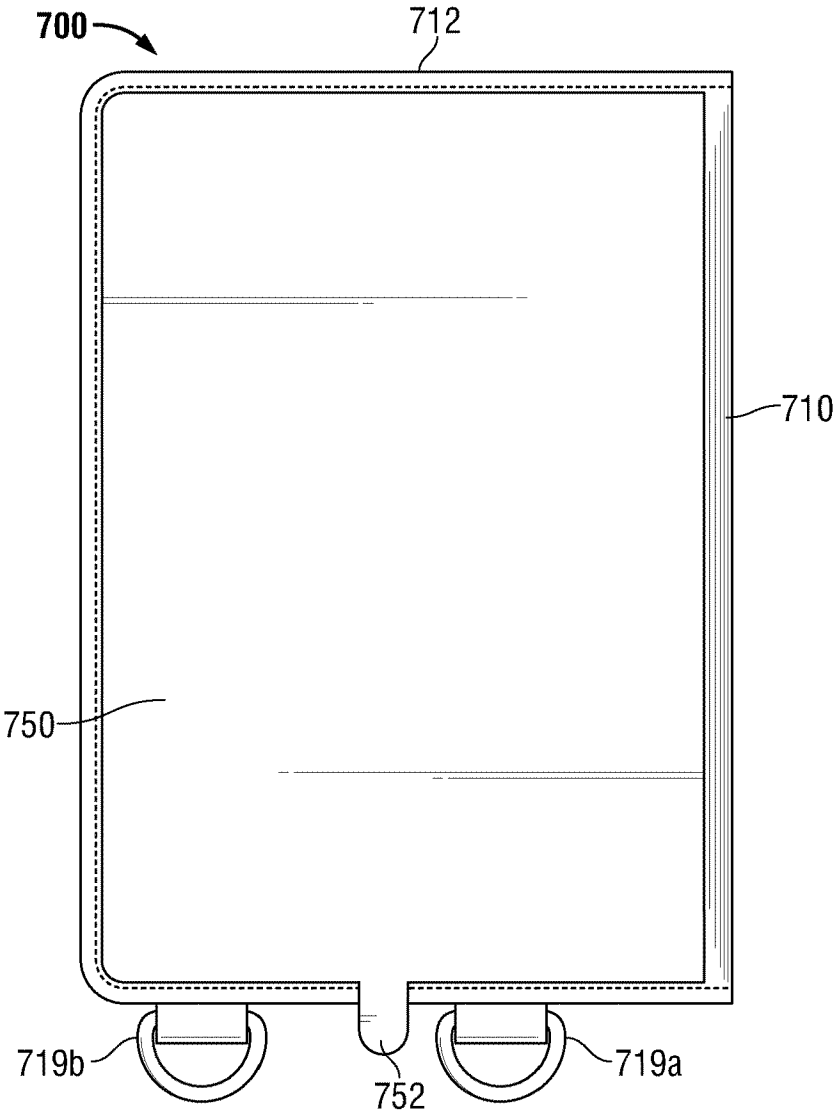
FIG. 10 shows a back view of the exterior of wallet feature 710 in the closed configuration.
Figure 9:
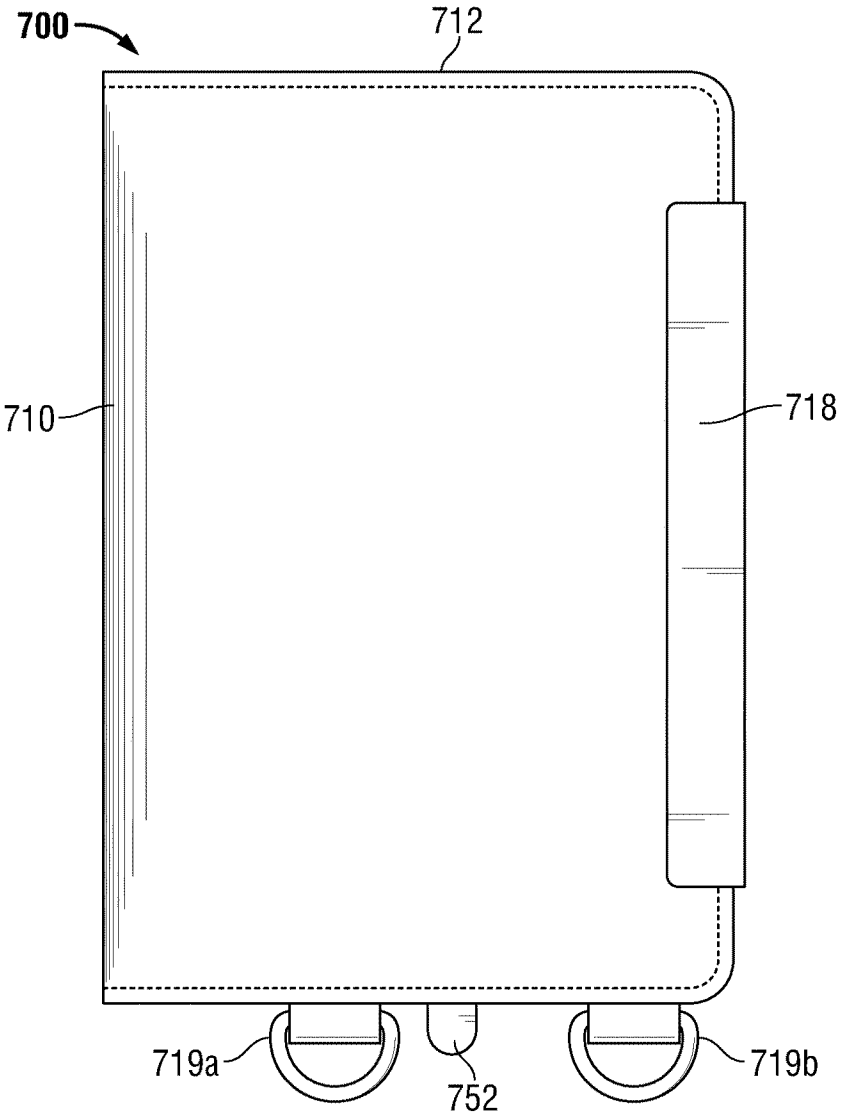
FIG. 9 shows a front view of the exterior of wallet feature 710 in the closed configuration.

FIG. 9 shows a front view of the exterior of wallet feature 710 in the closed configuration. FIG. 10 shows a back view of the exterior of wallet feature 710 in the closed configuration.

Although the present invention and its advantages have been described in detail, it should be understood that various changes, substitutions and alterations can be made herein without departing from the scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. An apparatus for carrying objects with a mobile communications device, the apparatus comprising:

a protective case adapted to receive a mobile communications device, the protective case formed from an elastomeric material that can absorb and dissipate energy from shocks and conforming to the shape of the mobile communications device, the protective case includes one or more rings, each ring adapted to receive a clasp;

a carrying strap fastened to the protective case; and two or more elastic loops, the two or more elastic loops adapted to stretch to receive and conform to a writing instrument, electronic cigarette, or vape pen, and hold the writing instrument, electronic cigarette, or vape pen parallel to the carrying strap via tension in the stretch material in a fixed position with respect to the carrying strap, such that the writing instrument, electronic cigarette, or vape pen contacts the carrying strap on one side and the two or more elastic loops on the opposite side, the strap extending through the two or more elastic loops, the two or more elastic loops fastened to the strap and spaced apart along the direction of the strap such that the writing instrument, electronic cigarette, or vape pen extends through the both of the two or more elastic loops, each of the two or more elastic loops attached to the elastic strap by fasteners.

2. The apparatus of claim 1, wherein the carrying strap is sufficient in length to loop from the hip of a user to the shoulder of the user.

3. The apparatus of claim 1, wherein the protective case includes one or more pockets adapted to receive credit-card sized items.

4. The apparatus of claim 3, further comprising a flap closeable over the one or more pockets.

5. The apparatus of claim 4, wherein the closeable flap in a closed configuration substantially covers the one or more pockets.

6. The apparatus of claim 4, wherein the closable flap is held in the closed position by one or more magnetic fasteners on the flap and one or more corresponding magnetic fasteners on a portion of the wallet feature affixed to the protective case.

7. The apparatus of claim 4, wherein the closeable flap includes a rigid protective member positioned only on a portion of a distal edge of the closeable flap to assist with opening the closeable flap.

8. The apparatus of claim 4, wherein the pockets and the flap are part of a wallet feature, the wallet feature affixed to the protective case by way of an adhesive.

9. The apparatus of claim 1, wherein the carrying strap includes a first carrying strap end having a first clasp adapted to be selectively fastened to the one or more rings.

10. The apparatus of claim 9, wherein the carrying strap end includes a second carrying strap end having a second clasp adapted to be selectively fastened to the one or more rings.

11. The apparatus of claim 1, wherein the carrying strap is sufficient in length to form a loop from the hip of a user to the shoulder of the user thereby enabling the user to carry the apparatus, and any objects disposed therein, without having to hold the apparatus in a hand.

12. The apparatus of claim 1, wherein the carrying strap is adjustable in length.

13. The apparatus of claim 1, wherein the two or more elastic loops are adapted to stretch to receive and conform to the writing instrument, electronic cigarette, or vape pen, having a cross-section that is not flat or that is substantially cylindrical.

14. The apparatus of claim 1, wherein a grip is disposed on the carrying strap within each loop.

15. The apparatus of claim 1, further comprising a wrist strap, the wrist strap having its ends connected together to form a loop adapted to be worn around the wrist of a user.

16. An apparatus for carrying objects with a mobile communications device comprising:

one or more pockets adapted to receive credit-card sized items;

a flap closeable over the one or more pockets, the flap including a rigid protective member positioned only on a distal edge of the flap to assist with opening the flap;

one or more rings, each ring adapted to receive a clasp from a carrying strap; and an adhesive layer on an exterior surface of the apparatus, a carrying strap; and two or more elastic, the two or more elastic loops adapted to stretch to receive and conform to an elongated object including a writing instrument, electronic cigarette, or vape pen, and hold the writing instrument, electronic cigarette, or vape pen parallel to the carrying strap via tension in the stretch material in a fixed position with respect to the carrying strap, such that the writing instrument, electronic cigarette, or vape pen contacts the carrying strap on one side and the one or more elastic loops on the opposite side, the strap extending through the two or more elastic loops, the two or more elastic loops fastened to the strap and spaced apart along the direction of the strap such that the writing instrument, electronic cigarette, or vape pen extends through the both of the two or more elastic loops, each of the two or more elastic loops attached to the elastic strap by fasteners;

the apparatus being a component separate from the mobile communications device and from a mobile communication device protective case and configured to be attached via the adhesive layer to the mobile communications device or to a mobile communications device protective case.

17. The apparatus of claim 16, further comprising a protective backing disposed on the adhesive layer to preserve and maintain the adhesive properties of the adhesive layer until the apparatus is applied by a user to a phone device or protective case for a phone device.

18. The apparatus of claim 17, further comprising a tab to facilitate the removal of the protective backing, wherein a portion of the tab is disposed between the adhesive layer and the protective backing.

19. The apparatus of claim 16, where the adhesive layer is disposed on a portion of the apparatus in a position that is suited for affixing the apparatus to a phone device or protective case for a phone device by way of the adhesive layer without inhibiting the ability of the flap to be selectively opened and closed.

20. An apparatus for carrying objects with a mobile communications device, the apparatus comprising:

a protective case adapted to receive a mobile communications device, the protective case formed from an elastomeric material that can absorb and dissipate energy from shocks and conforming to the shape of the mobile communications device, the protective case includes one or more rings, each ring adapted to receive a clasp;

a carrying strap fastened to the protective case;

two or more elastic loops, the two or more elastic loops adapted to stretch to receive and conform to an elongated object and hold the elongated object parallel to the carrying strap via tension in the stretch material in a fixed position with respect to the carrying strap, such that the elongated object contacts the carrying strap on one side and the two or more elastic loops on the opposite side, the strap extending through the two or more elastic loops, the two or more elastic loops fastened to the strap and spaced apart along the direction of the strap such that the elongated object extends through the both of the two or more elastic loops, each of the two or more elastic loops attached to the elastic strap by fasteners; and a grip is disposed on the carrying strap within each loop.

21. The apparatus of claim 20, wherein the carrying strap is sufficient in length to loop from the hip of a user to the shoulder of the user.

22. The apparatus of claim 20, wherein the protective case includes one or more pockets adapted to receive credit-card sized items.

23. The apparatus of claim 22, further comprising a flap closeable over the one or more pockets.

* * * * *